United States Patent [19]

Gamblin

[11] Patent Number: 4,564,565

[45] Date of Patent: Jan. 14, 1986

[54] METHOD OF MAKING LOW CONTACT RESISTANCE METALLIC COATINGS AND ELECTRICAL CONTACTS SO PRODUCED

[75] Inventor: Rodger L. Gamblin, Dayton, Ohio

[73] Assignee: Burlington Industries, Inc., Greensboro, N.C.

[21] Appl. No.: 611,968

[22] Filed: May 18, 1984

[51] Int. Cl.[4] ..... C25D 3/12

[52] U.S. Cl. ..... 428/680; 200/262; 204/49

[58] Field of Search ..... 204/49; 428/680; 200/262

[56] References Cited

FOREIGN PATENT DOCUMENTS 1346876 11/1963 France ..... 200/262
130296 8/1983 Japan ..... 204/49

OTHER PUBLICATIONS

W. A. Wesley et al., The Electrochemical Soc., Preprint 75-16, pp. 179-201, (1939).

J. K. Dennis et al., "Nickel and Chromium Plating", pp. 151-153 & 319, (1972).

*Primary Examiner*—G. L. Kaplan

*Attorney, Agent, or Firm*—Cushman, Darby & Cushman

[57] ABSTRACT

An electrical contact surface, suitable for use in producing electrical connectors, and having low surface contact resistance, is produced by the electrolytic deposition of nickel in crystalline form on a substrate. A plating bath is prepared containing nickel anions selected from the group consisting essentially of $TiF_6$—, $ZrF_6$—, $HfF_6$—, and $TaF_7$—. The nickel is preferably in the form of nickel chloride in an amount between about 0.1-2 molar, while the anion additives are in an amount between about one gram per liter and the solubility limit of the particular anion. The bath temperature, pH, and current density conditions are controlled to effect the deposition, and the electrical contact surface produced has a matte finish with nodules densely arranged on the surface. The contact resistance is less than that of a standard copper surface coated with 500 microinches of gold.

17 Claims, 3 Drawing Figures

METHOD OF MAKING LOW CONTACT RESISTANCE METALLIC COATINGS AND ELECTRICAL CONTACTS SO PRODUCED

BACKGROUND AND SUMMARY OF THE INVENTION

The invention relates to an electrical contact surface suitable for formation of electrical switch contacts, electrical connectors, and the like. Typically, electrical connectors are made from a copper, or like, substrate coated with nickel overlayered with gold. For instance one typical conventional electrical connector is a copper surface coated with 100 microinches of nickel overcoated with 50 microinches of gold. Gold offers both low contact resistance and resistance to corrosion. However, gold is very expensive and adds greatly to the cost of the electrical contact surfaces.

According to the present invention, an electrical contact surface is provided which has current resistance that compares favorably to that of conventional gold contact surfaces. The low contact resistance of the electrical contact surface according to the invention is particularly applicable to heremetically sealed environments, but can also have sufficient corrosion resistance to be used in a wide variety of environments. The electrical contact surface according to the invention is produced much more cheaply than standard electrical connectors with gold coatings.

According to one aspect of the present invention, a method is provided for forming an electrical contact surface by immersing a substrate in a particular plating bath. The plating bath includes the nickel ion as the primary depositable cation and the anion may be chloride, sulfate, sulfamate, or mixtures of these materials in an amount between about 0.10–2 molar, with a level of about 0.5 molar being preferred. The bath may also include anion additives selected from the group consisting essentially of $TiF_6$—, $ZrF_6$—, $HfF_6$—, and $TaF_7$—. The anions are in an amount between about one gram per liter and the solubility limit of the particular anions. The bath temperature and pH conditions are controlled so as to effect electrolytic deposition of the nickel in a crystalline form on the substrate. The temperature may be maintained between 5°–100° C., with a preferred level of about 60° C., while the pH is maintained between about 0.5–5, with a preferred level of about 1.5. Electrodeposition is not significantly affected by current density, within a wide range of current densities, the typical current densities being in the general area of 200 milliamperes per square centimeter. After electrolytic deposition, the substrate is removed from the bath.

The electrical contact surface that is produced according to the present invention has a matte finish, with asperities or nodules densely arranged on the surface. The nature of the nodules is such that a very high point contact pressure is created when contact is made, overcoming any oxidation or corrosion products which may be present. The nickel is in its normal crystalline form, and contains less than one percent of any other material. The contact resistance of the surface is low, e.g. on the order of 1.3 milliohms, and in any event usually less than 1.5 milliohms, which is the minimum contact resistance of conventional electrical connectors formed from a standard copper surface coated with 500 microinches of gold. Contact resistance is determined according to ASTM B667-80.

It is the primary object of the present invention to provide for the production of electrical contact surfaces having low contact resistance without the necessity of utilizing a gold coating. This and other objects of the invention will become clear from an inspection of a detailed description of the invention and from the appended claims.

DETAILED DESCRIPTION

Figure 1:
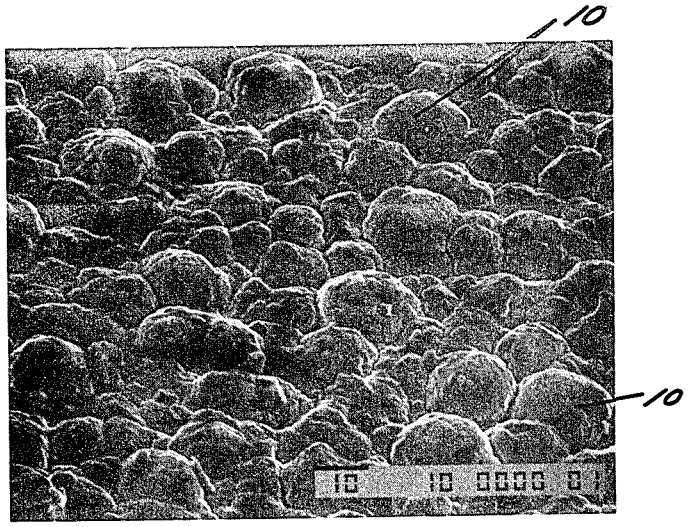
FIGS. 1–3 are magnified photographs taken of the surfaces of various exemplary electrical contacts according to the invention.

An electrical contact surface, suitable for formation of an electrical switch contact, electrical connector, or the like, is produced according to the invention by immersing a substrate in a particular plating bath. The substrate may comprise any conventional electrically conductive substrate material, such as copper, brass, or silver.

The plating bath includes nickel with almost any commonly used anion but which preferably is in the form of nickel chloride in an amount between about 0.1–2 molar, with a preferred level of about one-half molar. The bath temperature and pH conditions are maintained to produce appropriate electrodepositon of the nickel in cyrstalline form on the substrate. Typically the bath temperature would be between about 5°–100° C., with a preferred level of about 60° C., and the pH would be maintained between about 0.5–5, with a preferred level of about 3.0.

After electrodeposition of the nickel on the substrate, the substrate is removed from the bath. The electrical contact surface that results is dull and somewhat grey (almost black when wet), having a matte finish. Examination of the surface under a microscope reveals small rounded bright irregularities, or nodules, densely arranged on the surface. Upon analysis of the nickel surface no detectable levels (i.e. greater than one percent) of any other metal besides nickel can be found, and there is no indication that the nickel metal is in any form other than normal crystalline nickel. Exemplary nodles are shown by reference numerals 10, 11 and 12 in the drawings. It is believed that the nature of the nodules is such that a very high point contact pressure is created when contact is made, thus overcoming any oxidation or corrosion products which might be present and thus providing the desired low contact resistance of the electrical contact surface. The contact surface is maintained in that form, and is not mechanically polished, nor are the bath conditions maintained so as to brighten the platings. Brightened platings, or mechanical polishings of the platings, degrades the performance of the nickel electrodeposition.

Superior properties of the platings are obtained when certain anion additives are provided in the plating bath. The anions are selected from the group consisting essentially of $TiF_6$—, $ZrF_6$—, $HfF_6$—, and $TaF_7$—. The amount of additive is between one gram per liter and the solubility limit of the particular anion.

The desired results according to the invention are produced over a wide variety of current densities. Typically the current density would be generally in the area of 200 milliamperes per square centimeter.

Electrical contact surfaces produced according to the invention typically have low electrical contact resistance, consistently lower than the contact resistance of conventional electrical connectors formed from copper substrates coated with nickel and gold. That is, typically the electrical contact resistances of the electrical contact surfaces produced according to the present invention are less than 1.5 milliohms.

Figure 2:
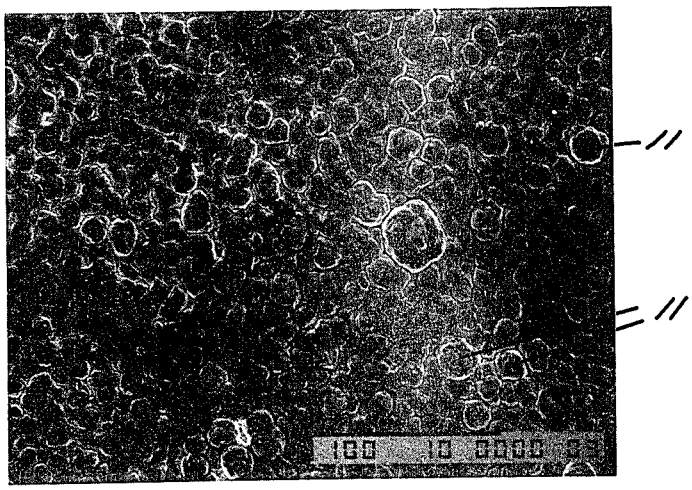
Figure 3:
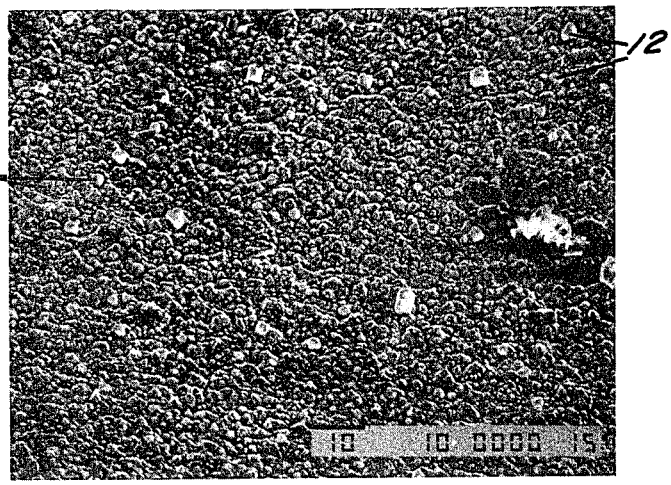

The drawings illustrate the distinctive characteristics of the electrical contact surface produced according to the invention. FIG. 1 is a 100× magnification of a contact surface tilted at 45°. The contact surface is obtained from electrodeposition in a bath of $NiCl_2$, according to the invention. FIG. 2 is a 350× magnifixiation (straight on, no tilt) of the same surface as in FIG. 1. FIG. 3 is a 1000× magnification of a contact surface tilted at 45°, this contact surface obtained from electrodeposition in a bath of $NiCl_2$ and $TaF_7$— ions (from $K_2TaF_7$). Nodules 10–12, and a matte finish, are clearly apparent in each.

The following are examples of the practice of the invention:

EXAMPLE 1

A plating bath was formed with the following composition:

$NiCl_2.6H_2O$—237.7 g/liter $K_2TaF_7$—45 g/liter

The pH of the bath was maintained at about 3.0 with HCl, and the temperature was maintained at about 60° C. 267 ml Standard Hull Cells and standard copper coated steel Hull cell plates (both the cells and plates produced by Kocour Company of Chicago, Ill.) were utilized.

A standard copper substrate was immersed in the bath, and after removal from the bath it was noted that a nickel electrodeposition thereon was dull and somewhat grey, having a matte finish. The electrical contact resistance of the plating was determined utilizing a Hewlett-Packard 4328-A, 4-lead milliohmeter in accordance with the procedures of ASTM B667-80 and utilizing a 100 g. load. To calibrate the instrument, a standard copper surface coated with 500 microinches of gold was utilized. The gold standard consistently yielded readings between 1.5–2.5 milliohms. The platings produced according to this example had a contact resistance of about 1.0 milliohms, substantially less than the gold standard.

EXAMPLE 2

A number of other plating baths were made up, all utilizing 267 ml Standard Hull Cells and standard Hull cell plates. In each case the nickel was in the form of one molar $NiCl_2$, the bath pH was maintained at about 1.5, and the temperature was maintained at about 80° C. Table I, below, gives the contact resistance (in milliohms) of the platings (with copper substrate) obtained according to this example at the different current densities indicated. For the entries where anions were provided as bath additives, in each case the anions were in an amount of about 45 grams/liter.

TABLE I

| | (Current Density of Plating Bath (in ma/cm$^2$)) | | | | |
|---|---|---|---|---|---|
| Bath Additive | 200 | 125 | 75 | 50 | 20 |
| None | 1.6 | 1.3 | 1.15 | .95 | 1.05 |
| $TiF_6$— | 1.25 | 1.2 | 1.15 | .95 | 1.05 |
| $TaF_7$— | 1.0 | 1.2 | 1.3 | 1.2 | 1.9 |
| $HfF_6$— | 1.2 | 1.0 | 1.6 | 1.15 | 1.25 |
| $ZrF_6$— | .85 | .9 | .9 | .82 | .82 |

Thus, in virtually every case, and particularly when $ZrF_6$—anions were utilized, the measured contact resistance of the contact surface produced was less than a comparable measurement of the gold standard.

EXAMPLE 3

A number of the plating samples produced in Example 2 were subjected to corrosive environments; particularly, they were subjected to a mixed gas test—100 percent relative humidity; one percent concentration each of $SO_2$, $Cl_2$, and $NO_2$; and room temperature, for a period of 24 hours. Standard 50 microinch gold plated connector pins were subjected to the mixed gas test along with the samples.

All gold plated connector pins were completely destroyed by the test. For the samples tested, after they were subjected to the mixed gases they were cleaned by rinsing in hot water prior to checking for contact resistance (without cleaning good contact resistance values would not have been achieved). The following Table II indicates the contact resistance (in milliohms) of the various plating samples set forth in Table I after the mixed gas test:

TABLE II

| | (Current Density of Plating Bath (in ma/cm$^2$)) | | | | |
|---|---|---|---|---|---|
| Bath Additive | 200 | 125 | 75 | 50 | 20 |
| None | 1.2 | 1.25 | 1.32 | 1.2 | damaged |
| $TiF_6$— | 2.2 | 2.8 | 1.9 | 1.2 | damaged |
| $ZrF_6$— | 1.1 | 1.3 | 1.15 | .8 | 1.2 |

EXAMPLE 4

Some of the plating samples produced in Example 2 were subjected to a standard time, temperature, humidity test. That, is the samples were placed in a humidity chamber at about 85 percent relative humidity, with the temperature maintained at about 51° C., and were maintained in the chamber for more than three months. The samples were removed and—without ay cleaning or rinsing of the contact surfaces—were subjected to current resistance testing. The results in the following Table III set forth the electrical contact resistances (in milliohms) of the indicated samples from Table I:

TABLE III

| | Current Density of Plating Bath (in ma/cm$^2$) | | | | |
|---|---|---|---|---|---|
| Bath Additive | 200 | 125 | 75 | 50 | 20 |
| $TiF_6$— | 1.8 | 2.5 | 2.4 | 2.7 | 2.2 |
| $TaF_7$— | .95 | 1.1 | 1.15 | 1.05 | 2.2 |

EXAMPLE 5

A number of variations of plating parameters were run. These included the examples shown in Table IV.

TABLE IV

| | PLATING CONDITIONS | | | | |
|---|---|---|---|---|---|
| Sample | Ni | pH | Temperature | Additives | Anion |
| 1 | 1 M | 4.75 | 80° C. | none | Chloride |
| 2 | 1 M | 2 | 80° C. | none | Sulfamate |
| 3 | 1 M | 2 | 80° C. | none | Sulfate |
| 4 | 1 M | 2 | 65° C. | none | Chloride |
| 5 | 1 M | 2 | 80° C. | $K_2ZrF_6$ | Chloride |
| 6 | 1 M | 2 | 80° C. | $K_2HfF_6$ | Chloride |
| 7 | 1 M | 3.5 | 80° C. | none | Chloride |
| 8 | .5 M | 2 | 80° C. | none | Chloride |
| 9 | 1 M | 2 | 80° C. | $K_2T_1F_6$ | Chloride |

TABLE IV-continued

| PLATING CONDITIONS | | | | | |
|---|---|---|---|---|---|
| Sample | Ni | pH | Temperature | Additives | Anion |
| 10 | 1 M | 2 | 80° C. | $K_2TaF_7$ | Chloride |

The contact resistances of the above platings were taken initially and again after two months. These values are shown in Table V.

TABLE V

| CONTACT RESISTANCE AVERAGE VALUE INITIALLY AND AFTER TWO MONTHS | | |
|---|---|---|
| SAMPLE | AS PREPARED mΩ | TWO MONTHS mΩ |
| 1 | 1.2 | 1.66 |
| 2 | 1.1 | 2.04 |
| 3 | 1.1 | 3.24 |
| 4 | 1.1 | 2.38 |
| 5 | .9 | 3.12 |
| 6 | 1.1 | 2.11 |
| 7 | 1.2 | 2.88 |
| 8 | .9 | 1.00 |
| 9 | .9 | .90 |
| 10 | .9 | 4.90 |

In addition to the foregoing a number of trials were run to determine the contact resistance when the plated substrates were exposed to a corrosive atmosphere and after a lengthy exposure to humid conditions. The results appear in Table VI.

TABLE VI

| Current Densities | 1 M $NiCl_2$, pH2, 80° C. Resistance Imm. after plating | After Corrosion env. | After 6 mos. in hum. |
|---|---|---|---|
| A/ft² | mΩ | mΩ | mΩ |
| 200 | .8 | 1.5 | 1.34 |
| 125 | .9 | 2.75 | 1.15 |
| 75 | .95 | off scale | 1.04 |
| 50 | .85 | 1.85 | .96 |
| 25 | 1.1 | 1.15 | .81 |
| **Current Densities** | **1 M $NiCl_2$, pH2, 70° C., 45 g/l $K_2ZrF_6$ Resistance Imm. after plating** | **After Corrosion env.** | **After 6 mos. in hum.** |
| A/ft² | mΩ | mΩ | mΩ |
| 200 | 2.45 | 2.13 | 3.88 |
| 125 | 1.09 | 1.7 | .8 |
| 75 | .945 | 1.3 | .72 |
| 80 | .80 | 1.47 | .76 |
| 25 | 1.14 | 1.18 | .97 |
| **Current Densities** | **1 M $NiCl_2$, pH2, 80° C., 45 g/l $K_2ZrF_7$ Resistance Imm. after plating** | **After Corrosion env.** | **After 6 mos. in hum.** |
| A/ft² | mΩ | mΩ | mΩ |
| 200 | 1.08 | 1.81 | 1.04 |
| 125 | .82 | 1.14 | 1.34 |
| 75 | .72 | 1.16 | .830 |
| 50 | .80 | 5.3 | .880 |
| 25 | 1.3 | 8.08 | .960 |
| **Current Densities** | **1 M $NiCl_2$, pH2, 70–75° C., 45 g/l $K_2TiF_6$ Resistance Imm. after plating** | **After Corrosion env.** | **After 6 mos. in hum.** |
| A/ft² | mΩ | mΩ | mΩ |
| 200 | 1.44 | 1.45 | 2.86 |
| 125 | .90 | 1.0 | off scale |
| 75 | .75 | 1.21 | 1.64 |
| 50 | .72 | 1.27 | 1.67 |
| 25 | .82 | off scale | .93 |
| **Current Densities** | **1 M $NiCl_2$, pH2, 80° C., 45 g/l $K_2TiF_6$ Resistance Imm. after plating** | **After Corrosion env.** | **After 6 mos. in hum.** |
| A/ft² | mΩ | mΩ | mΩ |
| 200 | 1.03 | off scale | 3.9 |
| 125 | .886 | 7.42 | 2.16 |
| 75 | .812 | off scale | 1.72 |
| 50 | .82 | 23.8 | 1.56 |
| 25 | .99 | 25.8 | 1.38 |
| **Current Densities** | **1 M $NiCl_2$, pH2, 80° C., 30 g/l $K_2TaF_7$ Resistance Imm. after plating** | **After Corrosion env.** | **After 6 mos. in hum.** |
| A/ft² | mΩ | mΩ | mΩ |
| 200 | 1.4 | off scale | 2.25 |
| 125 | 1.1 | " | 2.80 |
| 75 | .9 | " | 4.62 |
| 50 | 2.15 | " | 2.96 |
| 25 | 1.9 | " | 2.92 |
| **Current Densities** | **1 M $NiCl_2$, pH2, 60° C., 45 g/l $K_2TiF_6$ Resistance Imm. after plating** | **After Corrosion env.** | **After 6 mos. in hum.** |
| A/ft² | mΩ | mΩ | mΩ |
| 200 | 1.96 | off scale | 2.9 |
| 125 | 1.45 | " | 2.16 |
| 75 | .91 | " | 1.52 |
| 50 | .97 | " | 1.34 |
| 25 | 1.0 | " | off scale |

The contract resistance value for gold is measured to be approximately 1.5 milliohms. The foregoing results further confirm that the platings of the present invention are similar to or superior to gold even after corrosive treatment or prolonged exposure to water vapor.

It will thus be seen that while the electrical contact surfaces according to the invention may be made into electrical switch contacts or electrical connectors that are ideal for use in hermetically sealed environments, they also have use in other environments, maintaining their low contact resistance over time even under some adverse conditions. The contact surfaces according to the invention are not viewed as having any additional benefit if they are over-plated with gold, but rather achieve the desireable attributes of conventional gold coating without the associated costs.

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and methods.

What is claimed is:

1. A method of forming an electrical contact surface comprising the steps of:

(a) immersing an electrically conductive substrate in a plating bath comprising between about 0.1 and 2 molar nickel ion, the bath consisting of nickel and anions selected from the group consisting of $TiF_6$—, $ZrF_6$—, $HfF_6$—, and $TaF_7$—, and in an amount between about 1 gram/liter up to the solubility limit of the anions;

(b) controlling the bath temperature conditions, pH, and current density to effect electrolytic deposition of the nickel with a matte finish and in crystalline form on the substrate; and then (c) removing the substrate, with matte finish, from the bath.

2. A method as recited in claim 1 wherein step (b) is practiced by maintaining the bath temperature between about 5° and 100° C.

3. A method as recited in claim 2 wherein step (b) is practiced by maintaining the pH between about 0.5 and 5.

4. A method as recited in claim 1 wherein step (b) is practiced by maintaining the pH between about 0.5 and 4.

5. A method as recited in claim 1 consisting of said steps (a) through (c).

6. A method of forming an electrical contact surface comprising the steps of:

(a) immersing an electrically conductive substrate in a plating bath comprising between 0.1–2 molar nickel ion selected from the group consisting of nickel chloride, nickel sulfamate, nickel sulfate, and mixtures thereof, the bath consisting of nickel and anions selected form the group consisting of $TiF_6$—, $ZrF_6$—, $HfF_6$—, and $TaF_7$—, and in an amount between about 1 gram/liter up to the solubility limit of the anions;

(b) controlling the bath temperature conditions, pH, and current density to effect electrolytic deposition of the nickel on the substrate with a matte finish and in crystalline form; and then (c) removing the substrate, with matte finish, from the bath.

7. An electrical contact having a nickel matte contact surface with a contact resistance shortly after production of less than 1.5 milliohms, and produced by practicing the steps of:

(a) immersing an electrically conductive substrate in a plating bath consisting of between about 0.1 and 2 molar nickel ion, and between about 1 gram per liter up to the solubility limit of anions selected from the group consisting of $TiF_6$—, $ZrF_6$—, $HfF_6$—, and $TaF_7$—;

(b) controlling the bath temperature conditions, pH, and current density to effect electrolytic deposition of the nickel on the substrate; and then (c) removing the substrate from the bath.

8. A method of forming an electrical contact surface consisting of the steps of:

(a) immersing an electrically conductive substrate in a plating bath including nickel cations, and anions selected from the group consisting of: $TiF_6$—, $ZrF_6$—, $HfF_6$—, and $TaF_7$;

(b) controlling the bath temperature, pH, and current density to effect electrolytic deposition of the nickel, in crystalline form, on the substrate; and (c) removing the electrolytically deposited substrate from the bath.

9. A method as recited in claim 8, wherein step (b) is practiced by maintaining the bath temperature between about 5° and 100° C.

10. A method as recited in claim 9 wherein step (b) is practiced by maintaining the pH between about 0.5 and 4.

11. A method as recited in claim 8 wherein the nickel is in the form of nickel chloride in the bath, in an amount between about 0.1 molar–2 molar.

12. A method as recited in claim 11 wherein the anions in the bath are in an amount between about one gram per liter and the solubility limit of the particular anions.

13. A method as recited in claim 12 wherein step (b) is practiced by maintaining the bath temperature between about 5° and 100° C., and the pH between about 0.5 and 4.

14. The method as recited in claim 8 wherein the nickel is in the form of nickel sulfamate in the bath, in an amount between about 0.1 molar–2 molar.

15. A method as recited in claim 14 wherein the anions in the bath are in an amount between about 1 gram per liter and the solubility limit of the particular anions, and wherein step (b) is practiced by maintaining the bath temperature between about 5° and 100° C. and the small pH between about 0.5 and 4.

16. A method as recited in claim 8 wherein the anions in the bath are in an amount between about one gram per liter and the solubility limit of the particular anions.

17. A method as recited in claim 8 wherein said anion in the practice of step (a) consists of $ZrF_6$.

* * * * *